US011155934B2

(12) United States Patent
Beran et al.

(10) Patent No.: US 11,155,934 B2
(45) Date of Patent: Oct. 26, 2021

(54) METHOD FOR PRODUCING POLYMERIC NANOFIBRES BY ELECTRIC OR ELECTROSTATIC SPINNING OF A POLYMER SOLUTION OR MELT, A SPINNING ELECTRODE FOR THE METHOD, AND A DEVICE FOR THE PRODUCTION OF POLYMERIC NANOFIBRES EQUIPPED WITH AT LEAST ONE SUCH SPINNING ELECTRODE

(71) Applicant: Technicka Univerzita v Liberci, Liberec I-Stare Mesto (CZ)

(72) Inventors: Jaroslav Beran, Liberec XXX-Vratislavice Nad Nisou (CZ); David Lukas, Liberec VI-Rochlice (CZ); Pavel Pokorny, Vetrov (CZ); Tomas Kalous, Liberec XXX-Vratislavice Nad Nisou (CZ); Jan Valtera, Liberec I-Stare Mesto (CZ)

(73) Assignee: Technicka Univerzita v Uberci, Liberec l-Stare Mesto (CZ)

( * ) Notice: Subject to any disclaimer, the term of this patent is extended or adjusted under 35 U.S.C. 154(b) by 41 days.

(21) Appl. No.: 16/645,041

(22) PCT Filed: Sep. 6, 2018

(86) PCT No.: PCT/CZ2018/050047
§ 371 (c)(1),
(2) Date: Mar. 6, 2020

(87) PCT Pub. No.: WO2019/047990
PCT Pub. Date: Mar. 14, 2019

(65) Prior Publication Data

US 2021/0222327 A1 Jul. 22, 2021

(30) Foreign Application Priority Data

Sep. 7, 2017 (CZ) ..... CZ2017-521

(51) Int. Cl.
*D01D 5/06* (2006.01)
*D01D 5/00* (2006.01)

(52) U.S. Cl.
CPC ..... *D01D 5/0069* (2013.01)

(58) Field of Classification Search
CPC .. D01D 5/0061; D01D 5/0069; D01D 5/0007; D01D 5/0076; D01D 5/0092
See application file for complete search history.

(56) References Cited

U.S. PATENT DOCUMENTS 2,810,426 A * 10/1957 Smallman ..... D01D 5/003 264/438
6,382,526 B1 * 5/2002 Reneker ..... D01D 4/022 239/294

(Continued)

FOREIGN PATENT DOCUMENTS

CN 202090111 U 12/2011
CN 205474132 U 8/2016

(Continued)

OTHER PUBLICATIONS

CZ Search Report, dated Jun. 18, 2018.
PCT Search Report, dated Dec. 11, 2018.

*Primary Examiner* — Xiao S Zhao
*Assistant Examiner* — Emmanuel S Luk
(74) *Attorney, Agent, or Firm* — Dority & Manning, P.A.

(57) ABSTRACT

A spinning electrode for production of polymeric nanofibres by electric or electrostatic spinning of a polymer solution or melt includes a conduit for the polymer solution or melt. A spinning surface on the conduit is defined by a face of the conduit or an extension on the conduit. A screw shaft is disposed within an inner space of the conduit, wherein the screw shaft and an inner wall of the conduit form a screw conveyor. The screw shaft has a lower end that projects out (Continued)

from the conduit and is connected to a hub of a magnetic coupling.

15 Claims, 5 Drawing Sheets

(56) References Cited

U.S. PATENT DOCUMENTS

| | | | | |
|---|---|---|---|---|
| 2005/0029391 | A1* | 2/2005 | Cocciadiferro | B65H 19/10 242/559.1 |
| 2009/0127748 | A1* | 5/2009 | Takahashi | D01D 5/18 264/465 |
| 2010/0148405 | A1* | 6/2010 | Sumida | D04H 1/72 264/465 |

FOREIGN PATENT DOCUMENTS

| | | | |
|---|---|---|---|
| CZ | 299 216 | B6 | 5/2008 |
| CZ | 304 137 | B6 | 11/2013 |
| CZ | 306772 | B6 | 6/2017 |
| JP | 2010189782 | A | 9/2010 |
| WO | WO 2016/152999 | A1 | 9/2016 |
| WO | WO 2017/108012 | A1 | 6/2017 |

* cited by examiner

METHOD FOR PRODUCING POLYMERIC NANOFIBRES BY ELECTRIC OR ELECTROSTATIC SPINNING OF A POLYMER SOLUTION OR MELT, A SPINNING ELECTRODE FOR THE METHOD, AND A DEVICE FOR THE PRODUCTION OF POLYMERIC NANOFIBRES EQUIPPED WITH AT LEAST ONE SUCH SPINNING ELECTRODE

TECHNICAL FIELD

The invention relates to a method for the production of polymeric nanofibres by electric or electrostatic spinning of a polymer solution or melt.

The invention also relates to a spinning electrode for the production of polymeric nanofibres by electric or electrostatic spinning of a polymer solution or melt using this method.

In addition, the invention relates to a device the production of polymeric nanofibres by electric or electrostatic spinning of a polymer solution or melt equipped with at least one such spinning electrode.

BACKGROUND

Nowadays, there is a well-known method for the production of polymeric nanofibres by electrostatic spinning of a polymer solution or melt which is based on the use of direct current (DC) voltage. In this method, DC voltage of one polarity is supplied to at least one spinning electrode formed by a tube, a capillary tube or a nozzle, whereas DC voltage of the opposite polarity is supplied to at least one collecting electrode, the so-called collector, arranged opposite the spinning electrode/electrodes. In some variants, some of the electrodes (or one group of electrodes) may be grounded. In either case, between the collecting electrode/electrodes and the spinning electrode/electrodes is created an electrostatic field, which acts by its forces on a polymer solution or melt which is fed into this field through a cavity in the spinning electrode, forming on the surface of the polymer solution or melt the so-called Taylor cones, from which polymeric nanofibres are subsequently elongated. The polymeric nanofibres are then carried by the electrostatic field towards the collecting electrode/electrodes and usually prior to coming into contact with it/them, they are captured on the surface of a static or moving collector, most often a textile fabric.

CZ patent 304137 describes a method for the production of polymeric nanofibres by electric spinning of a polymer solution or melt in which alternating current (AC) voltage is used, which is supplied to the spinning electrode/electrodes. In this method, the electric field is created between the spinning electrode and oppositely charged air ions and/or gas ions, which are generated in the vicinity of the spinning electrode by the ionization of the surrounding air or gas and/or which are fed to its vicinity from an ion source, and/or oppositely charged nanofibres formed in the preceding moment. Due to regular change of phase and polarity of the AC voltage on the spinning electrode, the individual nanofibres or even different sections of the individual nanofibres bear opposite electrical charges and, as a result, almost instantly after being created by electrostatic forces, they cluster together into a sleeve-like formation in which the individual polymeric nanofibres change their direction in segments with a length in the order of micrometers, forming an irregular grid structure of mutually densely interlaced nanofibres with repeating points of contact between them, whereby this grid structure can be used, for example, for covering various surfaces, including threads, etc.

Furthermore, CZ PV 2015-928 discloses a method for the production of polymeric nanofibres by electric spinning of a polymer solution or melt using AC voltage, in which the excess of polymer solution or melt is fed to a spinning surface formed on an extended face of a capillary-shaped spinning electrode, whereby part of the solution or melt is spun and the residual solution or melt washes the spinning surface of the spinning electrode and, under the effect of gravity, it flows down on an adjoining collecting surface on which spinning no longer takes place. Due to this, there are no solidified residues of unspun solution or polymer melt or nanofibres formed during the preceding spinning operation stuck on the spinning surface of the spinning electrode, and therefore the spinning process can take place with unchanged intensity for a substantially unlimited time.

In addition, CZ PV 2015-928 also describes several embodiments of a spinning electrode with an extended face proposed for the above-described electric spinning method, whose common feature is that around at least a part of a mouth of a conduit of the polymer solution or melt is formed a spinning surface, which is rounded downward below the mouth of the conduit.

The drawback of the contemporary well-known methods for electric spinning using AC voltage, but also using DC voltage for electrostatic spinning, and of the spinning electrodes intended for these methods of spinning is, above all, the fact that the spinning electrode is completely separated from a reservoir of the solution or polymer melt and that the material for spinning is fed by a conduit formed by hoses or tubes. This arrangement not only increases the volume of the polymer solution or melt that must be available in the spinning device at all times and the pressures needed for their transport, but also the volume of the polymer solution or melt which is not spun eventually, which in the case of some polymers considerably increases the cost of the preparation of nanofibres. Another disadvantage is the fact that a larger volume of polymer solution or melt usually has also a larger surface area or larger area of the interface between the solution/melt and the wall of the tubes and hoses, which may result in faster solidification of the polymer solution or melt, or, in other words, its degradation—which is in the case of a solution caused by faster evaporation of the solvent and in the case of a melt by its faster cooling. Some of these drawbacks have been partially solved by a device known from CZ 299216, but this is a constructively and functionally very complicated solution and therefore completely unsuitable for industrial use.

Also, a very significant disadvantage of the existing electrostatic or electrostatic spinning devices is the fact that in order to transport the solution or polymer melt from the reservoir to the spinning surface of the spinning electrode, peristaltic pumps are usually used, causing pulsation of the solution or polymer melt flow on the spinning surface of the spinning electrode, which due to the change in the volume of the solution or melt currently present on the spinning surface, the movement of the solution or melt level and the change in its shape significantly worsens the uniformity of the spinning process and of the nanofibres being formed.

The aim of the invention is therefore to propose a spinning electrode for the production of polymeric nanofibres by electric or electrostatic spinning of a polymer solution or melt, a device for the production of polymeric nanofibres by electric or electrostatic spinning of a polymer solution or melt equipped with at least one such spinning electrode and a method for the production of polymeric nanofibres by electric or electrostatic spinning of a polymer solution or melt, which would not suffer from the above-mentioned drawbacks and would allow full use of the potential of both electrostatic and electrostatic spinning of a polymer solution or melt.

SUMMARY OF THE INVENTION

Additional objects and advantages of the invention will be set forth in part in the following description, or may be obvious from the description, or may be learned through practice of the invention.

The goal of the invention is achieved by a spinning electrode for the production of polymeric nanofibres by electric or electrostatic spinning of a polymer solution or melt, which contains a conduit of the polymer solution or melt, one face of which constitutes a spinning surface of the spinning electrode or which is at one of its ends provided with an extension on which is formed a downward rounded or cranked spinning surface of the spinning electrode, whose principle consists in that a screw shaft is rotatably mounted in the interior of the conduit of the polymer solution or melt of the spinning electrode. The screw shaft together with the inner wall of the conduit constitutes a screw conveyor. Furthermore, the screw shaft projects outward from the conduit by its lower end and is connected at this end to a hub of a magnetic coupling or is provided with means for connection to a hub of a magnetic coupling.

In order to avoid the screw shaft interference with the spinning process, it is advantageous if it is terminated at least by an inner diameter of the conduit of the polymer solution or melt of the spinning electrode below the end of this conduit.

To increase the performance of the spinning process, the conduit of the polymer solution or melt may be branched, whereby the faces of its branches form spinning surfaces of the spinning electrode and/or these branches are at their ends provided with extensions, on which the spinning surfaces of the spinning electrode are arranged.

In addition, the aim of the invention is also achieved by a device for the production of polymeric nanofibres by electric or electrostatic spinning of a polymer solution or melt which contains at least one reservoir of the polymer solution or melt and at least one spinning electrode containing a conduit of the polymer solution or melt, one face of which constitutes the spinning surface of the spinning electrode or which is at one end provided with an extension on which the spinning surface of the spinning electrode is arranged. The interior of the conduit of the polymer solution or melt and the reservoir of the polymer solution or melt are interconnected. The conduit of the polymer solution or melt of the spinning electrode extends with its lower end into the reservoir of the polymer solution or melt and with its upper end protrudes above it, and a screw shaft is mounted rotatably around its longitudinal axis in the interior of the conduit of the polymer solution or melt. The screw shaft together with the inner wall of the conduit of the polymer solution or melt constitutes a screw conveyor. The screw shaft is connected to a drive of the screw shaft by means of a magnetic coupling, whereby one hub of the magnetic coupling to which the screw shaft is connected is arranged in the reservoir of the polymer solution or melt, whereas the other hub is arranged outside this reservoir. The drive of the screw shaft is electrically separated from the reservoir of the polymer solution or melt.

It is advantageous if for the electrical separation of the drive from the reservoir of the polymer solution or melt, an insulation insert or an air gap is used, the insulation insert being made of an electrically nonconductive material, such as plastics. Should the need arise, the insulation insert may be connected to the screw shaft by means of a belt drive.

A collecting groove is preferably provided around at least a part of the circumference of the conduit of the polymer solution or melt on the outer surface of the reservoir of the polymer solution or melt. The collecting groove and the inner space of the reservoir are interconnected by at least one through hole. This groove collects the unspun polymer solution or melt and takes it back to the polymer solution or melt reservoir.

The conduit of the polymer solution or melt of the spinning electrode may be separate, passing into the inner space of the reservoir of the polymer solution or melt through its cover or wall, or it may be configured as an integral part of the reservoir.

In order to prevent the screw shaft from interfering with the spinning process, it is advantageous if it is terminated by at least the value of the inner diameter of the conduit of the polymer solution or melt of the spinning electrode below the end of this conduit.

To increase the performance of spinning, the conduit of the polymer solution or melt may be branched, whereby the faces of its branches constitute the spinning surfaces of the spinning electrode and/or these branches are at their ends provided with extensions on which the spinning surfaces of the spinning electrode are arranged. For the same reason, the conduit of the polymer solution or melt of more than one spinning electrode may enter the inner space of one reservoir of the solution or polymer melt.

The aim of the invention is further achieved by a method for the production of polymeric nanofibres by electric or electrostatic spinning of a polymer solution or melt, in which the polymer solution or melt is fed from the reservoir of the polymer solution or melt by the conduit of the polymer solution or melt to the spinning surface of the spinning electrode, which is formed by the face of the conduit or which is formed on the extension arranged at the end of the conduit, whereby AC or DC voltage is supplied to the spinning electrode and/or to the polymer solution or melt, and the polymer solution or melt is spun from the spinning surface of the spinning electrode. The polymer solution or melt is fed to the spinning surface of the spinning electrode by the action of a rotating screw shaft arranged in the inner space of the conduit of the polymer solution or melt. The screw shaft and the inner wall of the conduit form a screw conveyor. The excess of polymer solution or melt is fed to the spinning surface by the screw conveyor and the unspun polymer solution or melt washes the spinning surface of the spinning electrode, whereupon under the effect of gravity it flows down on the collecting surface on the outer surface of the conduit of the polymer solution or melt, whereby no further process of electrospinning takes place on this collecting surface.

The polymer solution or melt from the outer surface of the conduit of the polymer solution or melt is then preferably captured in the collecting groove, from which it returns through at least one through hole into the reservoir of the polymer solution or melt.

DESCRIPTION

Figure 1:
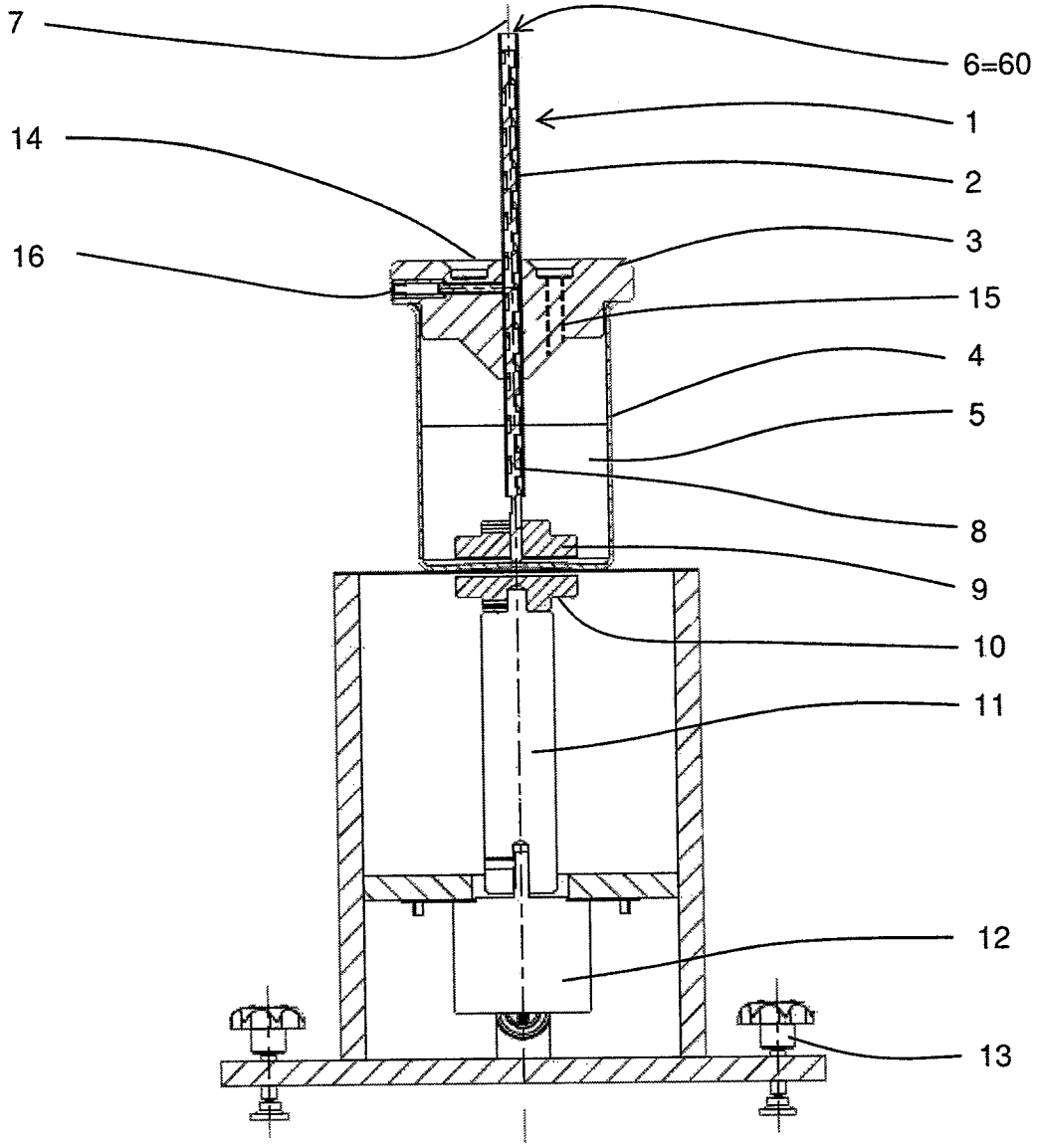
FIG. 1 schematically shows a cross-section of the first exemplary variant of a device for the production of polymeric nanofibres by electric or electrostatic spinning of a polymer solution or melt according to the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
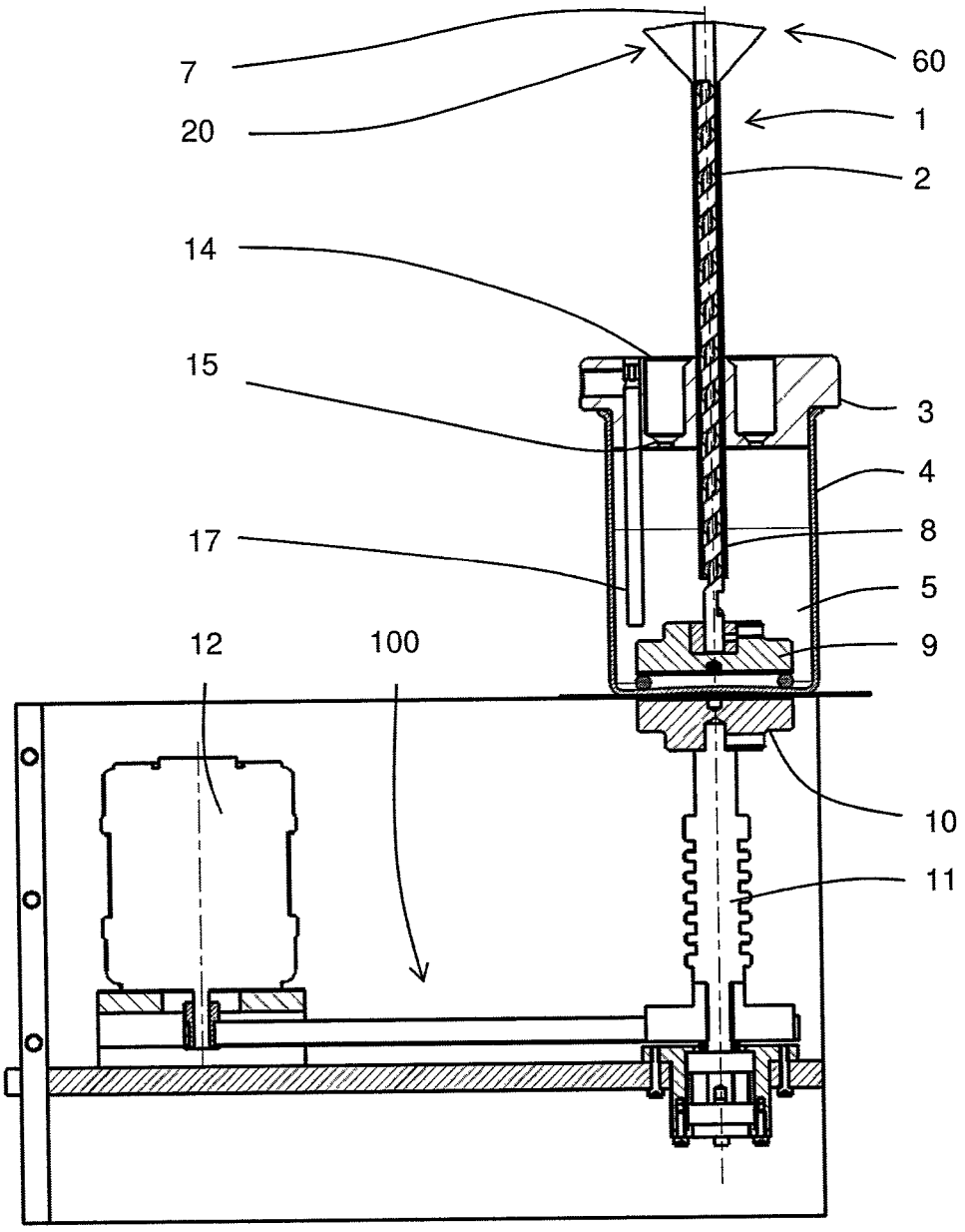
FIG. 2 shows a cross-section of the second exemplary variant of this device.

The principle of the invention will be explained with reference to two exemplary embodiments of the device for the production of polymeric nanofibres by electric spinning of a polymer solution or melt schematically represented in FIG. 1 and FIG. 2. The embodiment shown in FIG. 1 is based on the use of a well-known spinning electrode which contains a conduit of a polymer solution or melt consisting of a tube, one face of which constitutes the spinning surface of the spinning electrode. The embodiment shown in FIG. 2 is based on the use of a spinning electrode disclosed in CZ PV 2015-928, which contains a conduit of the polymer solution or melt consisting of a tube, which is at one of its ends provided with an extension on which a downward rounded spinning surface of the spinning electrode is formed. Nevertheless, it is apparent that this principle is applicable also to other types of devices for electric or electrostatic spinning of a polymer solution or melt using alternating current (AC) or direct current (DC) voltage, which are provided with spinning electrodes containing a conduit of the polymer solution or melt in the form of a tube, a capillary tube, or a similar elongated hollow body, regardless of the shape or size of its cross-section, or of the shape or the size of the spinning surface.

The device for the production of polymeric nanofibres by electric spinning of a polymer solution or melt according to the invention, schematically represented in FIG. 1, contains a spinning electrode 1, which contains a conduit 2 of the polymer solution or melt 5 formed by a tube. The conduit 2 is mounted in a cover 3 of a reservoir 4 of the polymer solution or melt 5 and is oriented vertically upwards with its lower end extending into the reservoir 4, below the surface of the polymer solution or melt 5 contained therein and with its upper end protruding above the reservoir 4. The surface 6 of the face of this end constitutes the spinning surface 60 of the spinning electrode 1, which has an annular shape in the illustrated example of embodiment.

In the inner space of the conduit 2 of the polymer solution or melt 5 of the spinning electrode 1, a screw shaft 8 is mounted rotatably around its longitudinal axis, which is preferably identical to the longitudinal axis 7 of this inner space. The screw shaft 8 together with the inner wall of the conduit 2 forms a screw conveyor. The lower end of the screw shaft 8 extends outwards from the interior of the conduit 2 of the polymer solution or melt 5 and is connected, preferably detachably, to a hub 9 of a magnetic coupling, the hub 9 being arranged in the interior of the reservoir 4 of the polymer solution or melt 5. The second hub 10 of the magnetic coupling is arranged outside the reservoir 4, in the illustrated example of embodiment below it, and is connected to a drive 12, for example an electric motor, by means of an insulation insert 11 made of an electrically non-conductive material, preferably plastics. In this manner, the drive 12 is electrically separated from the reservoir 4 of the polymer solution or melt 5. In an embodiment not shown, a different known element can be used to separate it, for example a sufficiently large air gap, etc.

The conduit 2 of the polymer solution or melt 5 of the spinning electrode 1 is mounted detachably or undetachably in the cover 3 of the reservoir 4 of the polymer solution or melt 5. The cover 3 is around its circumference provided with a collecting groove 14, which is by means of at least one through hole 15 (indicated by a dashed line) connected to the inner space of the reservoir 4. Furthermore, in the illustrated variant, the cover 3 is also provided with a connector 16 and/or a groove for connecting the spinning electrode 1 to an unillustrated source of AC or DC voltage. In other unillustrated embodiments, this connection is realized by other known means, or by other known means differently mounted, or, alternatively, the cover 3 or another part of the reservoir 4 may be provided with a contact which extends to the polymer solution or melt 5 (see, for example, the variant shown in FIG. 2) in the reservoir 4 and which is used for supplying DC or AC voltage directly to the polymer solution or melt 5.

FIG. 2 schematically represents a variant of the device for the production of polymeric nanofibres by electric spinning of a polymer solution or melt according to the invention, which contains the spinning electrode 1 known from CZ PV 2015-928, which contains a conduit 2 of the polymer solution or melt 5 consisting of a tube, which is provided with a conical extension 20 at one of its ends. Around the circumference of the conical extension 20 is formed a downward rounded spinning surface 60 of the spinning electrode 1, to which is connected a downward oriented collecting surface for the removal of the unspun polymer solution or melt 5, which is formed by the outer surface of the conduit 2 of the polymer solution or melt 5. The extension 20 is either an integral part the conduit 2 of the polymer solution or melt 5, or it is formed by a body which is, preferably detachably, connected to the conduit 2. This construction makes it possible to produce a greater amount of polymeric nanofibres due to the larger spinning surface 60, most of them being formed under the same conditions—i.e., in the same part of the electric field and at the same intensity, or, in other words, at the same degree of the force effect of this field on the polymer solution or melt 5. Due to this, the nanofibres produced by using this spinning electrode 1 have very similar parameters, particularly the diameter, or lower variance of these parameters.

As in the embodiment shown in FIG. 1, the screw shaft 8 is mounted in the interior of the conduit 2 of the polymer solution or melt 5 of the spinning electrode 1 and is rotatable around its longitudinal axis, which is preferably identical to the longitudinal axis 7 of this inner space, whereby the screw shaft 8 together with the inner wall of the conduit 2 constitutes a screw conveyor. The lower end of the screw shaft 8 extends outward from the interior of the conduit 2 of the polymer solution or melt 5 and is connected, preferably detachably, to a hub 9 of a magnetic coupling, the hub 9 being arranged in the interior of the reservoir 4 of the polymer solution or melt 5. The second hub 10 of the magnetic coupling is then arranged outside the reservoir 4, in the variant of the conduit shown below the reservoir 4, on the insert 11, preferably made of an electrically non-conductive material, such as plastics, which is by means of a belt drive 100 coupled to a drive 12, for example an electric motor. In this manner, the drive 12 is electrically separated from the reservoir 4 containing the polymer solution or melt 5. In an embodiment not shown, a different known element can be used to separate it, such as a sufficiently large air gap, etc.

The conduit 2 of the polymer solution or melt 5 of the spinning electrode 1 is mounted detachably or undetachably in the cover 3 of the reservoir 4 of the polymer solution or melt 5. In addition, the cover 3 is around its circumference provided with a collecting groove 14, which is by means of two through holes 15 connected to the inner space of the reservoir 4. In addition, the cover 3 is in the illustrated embodiment provided also with a groove and a contact 17 which extends into the polymer solution or melt 5 in the reservoir 4, and which serves to connect the polymer solution or melt to a source of AC and DC voltage (not shown). In other embodiments not shown, this connection is realized by other known means, or otherwise mounted; alternatively, the cover 3 may be provided with means of connecting the conduit 2 of the spinning electrode 1 to the AC or DC voltage source of (see, for example, the variant shown in FIG. 1).

The screw shaft 8 arranged in the interior of the conduit 2 of the polymer solution or melt 5 of the spinning electrode 1 can be made of any material, both electrically non-conductive and electrically conductive. In either case, it is advantageous if the conduit 2 of the polymer solution or melt 5 of the spinning electrode 1 is terminated by at least the value of the inner diameter below the end of the conduit, so as not to interfere with the spinning process by its presence. The speed of its rotation during spinning (see below) is preferably 25 to 400 rpm, with a pitch of preferably 5 to 20 mm; however, depending on the properties of the polymeri solution or melt 5 being spun, any of these parameters may be outside the above range.

The above variants of the device for the production of polymeric nanofibres by electric spinning of a polymer solution or melt are only described by way of example for better understanding of the principle of the invention. In other embodiments, the conduit 2 of the polymer solution or melt 5 of the spinning electrode 1 may be mounted in the reservoir 4 of the polymer solution or melt 5 otherwise—instead of being mounted in the cover 3 of the reservoir 4, it may be mounted, for example, in any of its walls, or, alternatively, it may be even an integral part of the reservoir 4. Should the need arise, the conduit 2 of the spinning electrode 1 may be oriented otherwise than vertically, e.g., obliquely upward, etc. In all the variants, it is advantageous if the collecting groove 14 is formed around at least part of the circumference of the conduit 2 on the outer surface of the reservoir 4 of the polymer solution or melt 5, the collecting groove 14 being connected to the inner space of the reservoir 4 of the polymer solution or melt by means of at least one through hole 15.

In order to achieve a higher performance of the spinning process, it is also possible to associate one reservoir 4 of the polymer solution or melt 5 with more spinning electrodes 1, whose conduits 2 of the polymer solution or melt 5 extend into its inner space, below the level of the polymer solution or melt 5 stored in it, or, alternatively, it is possible to divide the conduit 2 of the polymer solution or melt 5 into branches and assign to it a plurality of spinning surfaces 60 consisting of the faces 6 of the branches and/or formed on their extensions 20 etc.

Preferably, but not necessarily, the reservoir 4 of the polymer solution or melt 5 is mounted on/in a suitable frame or casing. It is advantageous if this frame/casing is provided with at least one adjusting element, for example an adjusting screw 13, to stabilize the spinning surface 60 of the spinning electrode 1 in the horizontal position, where it is evenly washed with the polymer solution or melt 5 (see the description below) and, at the same time, the spinning process is more uniform.

During the production of nanofibres by the method according to the invention, the drive 12 by means of the magnetic coupling consisting of the hubs 9 and 10 drives the screw shaft 8, which, while rotating, transports the polymer solution or melt 5 through the conduit 2 of the polymer solution or melt from the reservoir 4 to the spinning surface/surfaces 60 of the spinning electrode 1, where it is spun in a well-known manner. The amount of the polymer solution or melt 5 fed to the spinning surface/surfaces 60 of the spinning electrode 1 is greater than the amount that can be spun under the given conditions and the unspun excess of the polymer solution or melt 5 washes the spinning surface/surfaces 60 of the spinning electrode 1, due to which there is no undesirable adhesion of the solidified solution or polymer melt and nanofibers on the spinning surface/surface 60, which ensures that the spinning from the respective spinning surface/surfaces 60 can take place at the same or substantially unchanged intensity for a substantially unlimited period of time. This excess of polymer solution or melt 5 flows down by the effect of gravity over the outer surface of the conduit 2 of the polymer solution or melt 5 of the spinning electrode 1 into the collecting groove 14, and, through at least one through hole 15, it returns from the collecting groove 14 to the reservoir 4 in which, due to the rotation of the magnetic coupling hub, it is mixed with the stored polymer solution or melt 5. If necessary, the concentration of the polymer solution is adjusted or the polymer melt is heated or, alternatively, at least one suitable admixture is added to the polymer solution or melt, and the polymer solution or melt 5 returns again through the conduit 2 of the polymer solution or melt 5 to the spinning surface/surfaces 60 of the spinning electrode 1. Further homogenization of the polymer solution or melt 5 occurs as a result of the rotation of the screw shaft 8 also in the inner space of the conduit 2 of the polymer solution or melt 5, which enables to add, if appropriate, an admixture/admixtures, such as metal, a low molecular substance, etc., for example in the sense of CZ patent 300797, or a precursor of such an admixture/such admixtures to the polymer solution or melt 5 directly in the inner space of the conduit 2.

This method for electric spinning of a polymer solution or melt 5 thus reduces the amount of the polymer solution or melt 5, which must be stored in the reservoir 4, as well as the amount of the polymer solution or melt 5, which in the end is not spun. In addition, the screw conveyor provides a constant delivery of the polymer solution or melt 5 to the spinning surface/surfaces 60 of the spinning electrode 1, without pulsation, thereby further contributing to the high uniformity of the spinning process and of the nanofibres being formed.

To increase the mixing intensity of the polymer solution or melt 5 in the reservoir 4, the hub 9 of the magnet coupling accommodated in the reservoir 4 and, if appropriate, also the part of the screw shaft 8 projecting outward from the conduit 2 of the polymer solution or melt 5 may be provided with at least one suitable insert or protrusion.

If desired, however, the polymer solution or melt 5 can be discharged from the collecting surface into waste.

In the following examples, an exemplary embodiment of the spinning electrode 1 according to the present invention and exemplary variants for performing the method for the production of polymeric nanofibres by electric spinning of the solution or melt 5 according to the invention are described in more detail for clarity. As is apparent, these examples are for illustrative purposes only and do not limit the applicability of the invention.

Example 1

The spinning electrode 1 contained a conduit 2 of the polymer solution or melt 5 consisting of a 200 mm long stainless steel tube with an inner diameter of 8 mm and an outer diameter of 10 mm, which at its upper end was terminated by a working portion formed by a conical extension 20 having a width of 25 mm at its widest point. Mounted in the interior of the conduit 2 was a screw shaft 8 having a diameter of 6 mm and a pitch of 10 mm, which passed through the entire length of the conduit and was terminated 8 mm below its upper end.

The conduit 2 of the polymer solution or melt 5 of the spinning electrode 1 was vertically mounted in the cover 3 of the reservoir 4 of the polymer solution or melt 5, which was formed by standard glass beaker having a volume of 400 ml and in which 10% solution of polyvinyl butyral in ethanol was stored.

Via a connector 16, the conduit 2 was connected to a source of AC voltage from which an AC voltage of 33000 V and frequency of 50 Hz, was fed to the conduit 2.

The distance of the spinning surface 60 of the spinning electrode 1 from the cylindrical collector was 20 cm.

During spinning, the screw shaft 8 rotated at a speed of 300 to 400 rpm (typically 375 rpm), delivering the polyvinyl butyral solution to the spinning surface 60 of the spinning electrode 1 at a rate of 20 ml/min.

Figure 3:
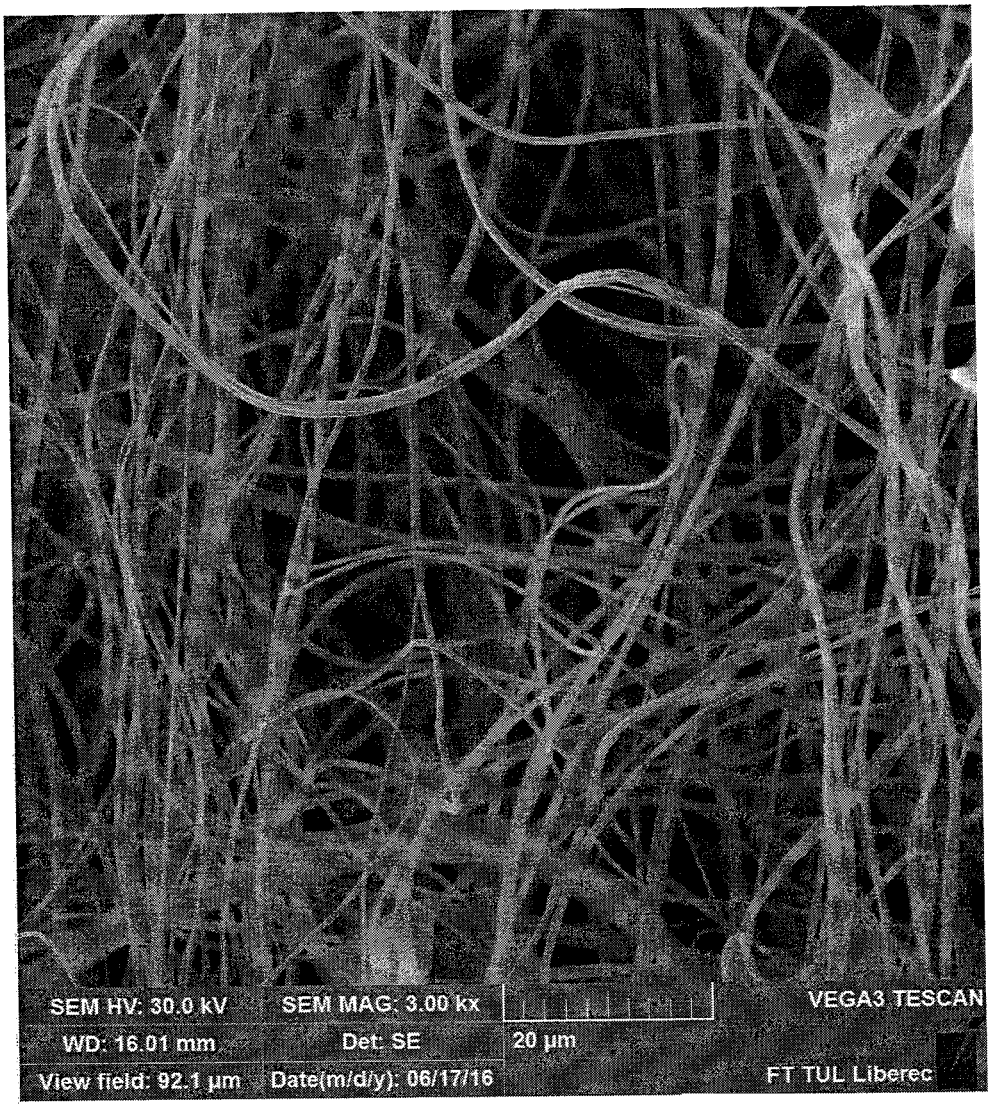
FIG. 3 shows an SEM image of nanofibres from polyvinyl butyral at 3000× magnification prepared by the method according to the invention.

The spinning took place for 3 hours to produce polyvinyl butyral nanofibres with a diameter of 250 to 1200 nm, the SEM image of which at 3000× magnification is shown in FIG. 3.

Example 2

The spinning electrode 1 contained a conduit 2 of a polymer solution or melt 5 consisting of a 200 mm long stainless steel tube with an inner diameter of 8 mm and an outer diameter of 10 mm, which at its upper end was terminated by a working portion formed by a conical extension 20 having a width of 25 mm at its widest point. Mounted in the interior of the conduit 2 was a screw shaft 8 having a diameter of 6 mm and a pitch of 10 mm, which passed through the entire length of the conduit and was terminated 8 mm below its upper end.

The conduit 2 of the polymer solution or melt 5 of the spinning electrode 1 was vertically mounted in the cover 3 of the reservoir 4 of the polymer solution or melt 5, which was formed by standard glass beaker having a volume of 400 ml and in which 12% solution of polyvinyl alcohol in water was placed.

Via the connector 16, the conduit 2 was connected to a source of AC voltage from which an AC voltage of 35000 V and frequency of 100 Hz, was fed to the conduit 2.

The distance of the spinning surface 60 of the spinning electrode 1 from the cylindrical collector was 20 cm.

During spinning, the screw shaft 8 rotated at a speed of 300 to 400 rpm (typically 375 rpm), delivering the polyvinyl alcohol solution to the spinning surface 60 of the spinning electrode 1 at a rate of 20 ml/min.

Figure 4:
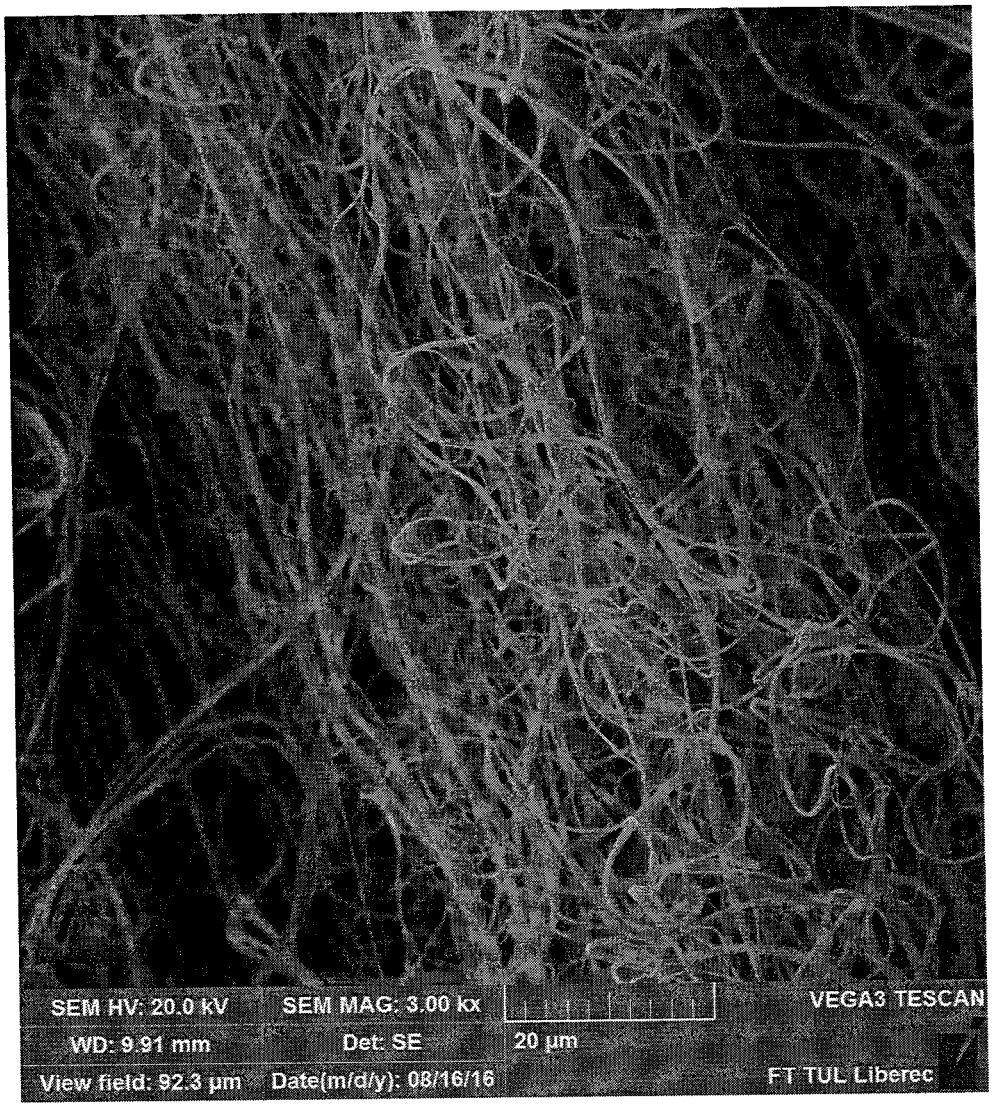
FIG. 4 shows an SEM image of nanofibres from polyvinyl alcohol at 3000× magnification prepared by the method according to the invention.

The spinning took place for 1 hour to produce polyvinyl alcohol nanofibres with a diameter of 250 to 1200 nm, the SEM image of which at 3000× magnification is shown in FIG. 4.

Example 3

The spinning electrode 1 contained a conduit 2 of the polymer solution or melt 5 consisting of a 200 mm long stainless steel tube with an inner diameter of 8 mm and an outer diameter of 10 mm, which at its upper end was terminated by a working portion formed by a conical extension 20 having a width of 25 mm at the widest point. Mounted in the interior of the conduit 2 was a screw shaft 8 having a diameter of 6 mm and a pitch of 10 mm, which passed through the entire length of the conduit and was terminated 8 mm below its upper end.

The conduit 2 of the polymer solution or melt 5 of the spinning electrode 1 was vertically mounted in the cover 3 of the reservoir 4 of the polymer solution or melt 5, which was formed by standard glass beaker having a volume of 400 ml and in which a 10% solution of polyamide 6 (PA6) in a mixture of formic acid and acetic acid (in a 1:1 mutual ratio) was stored.

By means of a connector 16, the conduit 2 was connected to a source of AC voltage from which an AC voltage of 31000 V and frequency of 50 Hz, was fed to the conduit 2.

The distance of the spinning surface 60 of the spinning electrode 1 from the cylindrical collector was 15 cm.

During spinning, the screw shaft 8 rotated at a speed of 300 to 400 rpm (typically 375 rpm), delivering the polyamide 6 solution to the spinning surface 60 of the spinning electrode 1 at a rate of 20 ml/min.

Figure 5:
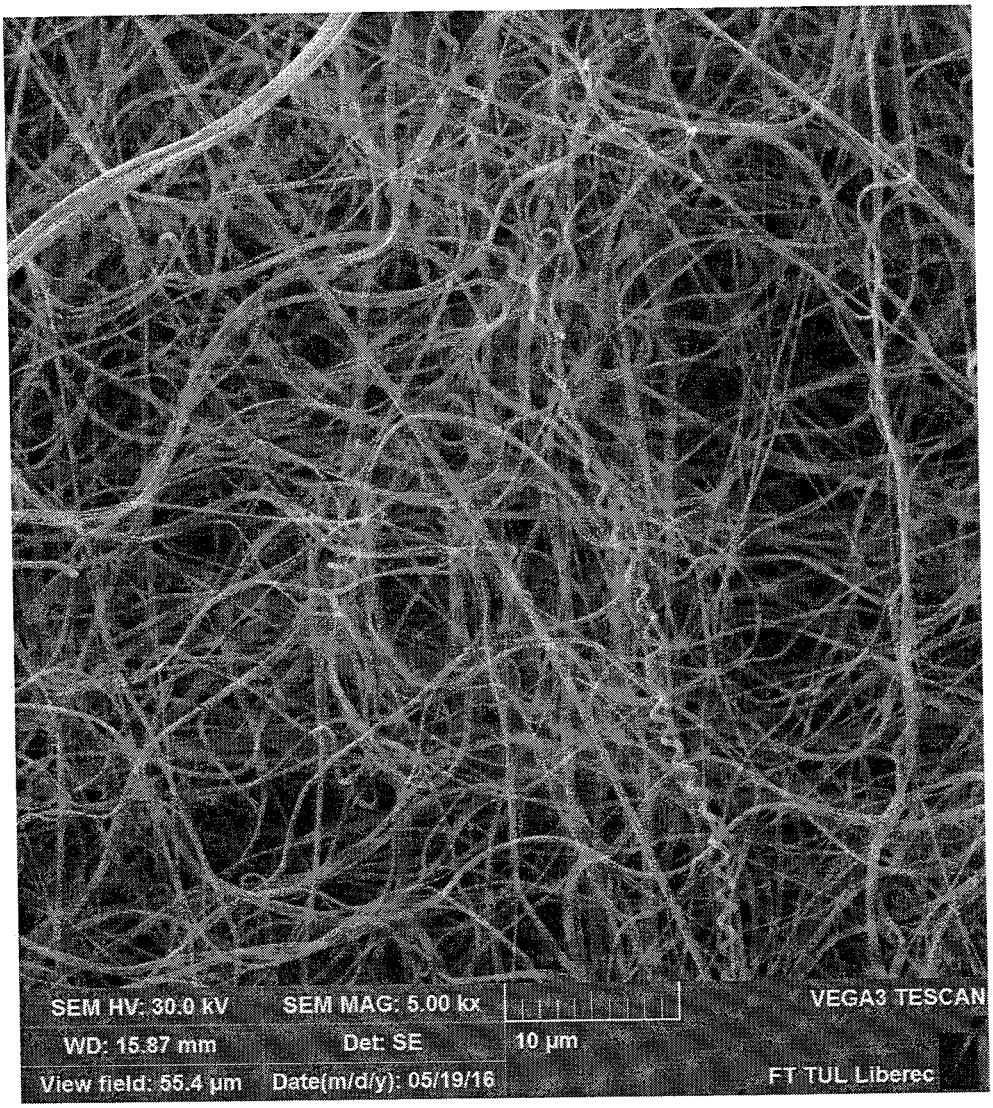
FIG. 5 an SEM image of nanofibres from polyamid 6 at 5000× magnification prepared by the method according to the invention.

The spinning took place for 3 hours to produce polyamid 6 nanofibres with a diameter of 250 to 1200 nm, the SEM image of which at 5000× magnification is shown in FIG. 5.

LIST OF REFERENCES

1 spinning electrode
2 conduit of the polymer solution or melt
20 extension of the conduit of the polymer solution or melt
3 cover of the reservoir of the polymer solution or melt
4 reservoir of the polymer solution or melt
5 polymer solution or melt
6 face of the conduit of the polymer solution or melt
60 the spinning surface of the spinning electrode
7 longitudinal axis of the inner space of the conduit of the polymer solution or melt
8 screw shaft
9 hub of a magnetic coupling
10 hub of a magnetic coupling hub
100 belt drive
11 insulation insert
12 drive of the screw shaft
13 adjusting screw
14 collecting groove
15 through hole
16 connector
17 contact

The invention claimed is:

1. A spinning electrode for production of polymeric nanofibres by electric or electrostatic spinning of a polymer solution or melt, comprising:

a conduit for the polymer solution or melt;

a spinning surface on the conduit defined by a face of the conduit or an extension on the conduit;

a screw shaft disposed within an inner space of the conduit, wherein the screw shaft and an inner wall of the conduit form a screw conveyor; and the screw shaft comprising a lower end that projects out from the conduit and is connected to a hub of a magnetic coupling.

2. The spinning electrode according to claim 1, wherein the screw shaft is terminated at least by a value of an inner diameter of the conduit below an end of the conduit.

3. The spinning electrode according to claim 1, wherein the conduit comprises a plurality of branches, each branch comprising a face or an extension that provides the spinning surface.

4. A device for production of polymeric nanofibres by electric or electrostatic spinning of a polymer solution or melt, comprising:

a reservoir having an inner space for the polymer solution or melt;

a spinning electrode, the spinning electrode further comprising:

a conduit for the polymer solution or melt;

a spinning surface on the conduit defined by a face of the conduit or an extension on the conduit;

a screw shaft disposed within an inner space of the conduit, wherein the screw shaft and an inner wall of the conduit form a screw conveyor;

a lower end of the conduit extending into the reservoir and an upper end of the conduit projecting above the reservoir;

a magnetic coupling comprising a first hub within the reservoir and a second hub outside of the reservoir;

the screw shaft comprising a lower end that projects out om the conduit and is connected to the first hub of the magnetic coupling; and the second hub of the magnetic coupling connected to a drive that rotationally drives the screw shaft via the first hub such that the drive is electrically separated from the reservoir.

5. The device according to claim 4, wherein the second end of the magnetic coupling is connected to the drive via an insulation insert.

6. The device according to claim 5, wherein the insulation insert (11) and the drive are interconnected by a belt drive.

7. The device according to claim 4, further comprising a collecting groove formed on an outer surface of the reservoir and extending around at least a part of a circumference of the conduit, the collecting groove comprising at least through one through hole in communication with the inner space of the reservoir.

8. The device according to claim 4, wherein the conduit is formed as an integral part of the reservoir.

9. The device according to claim 4, wherein the conduit passes through a cover or a wall of the reservoir.

10. The device according to claim 4, wherein the screw shaft is terminated at least by a value of an inner diameter of the conduit below an end of the conduit.

11. The device according to claim 4, wherein the conduit comprises a plurality of branches, each branch comprising a face or an extension that provides the spinning surface.

12. The device according to claim 4, wherein the reservoir is connectable to a source of AC or DC voltage.

13. The device according to claim 4, comprising two of the spinning electrodes configured with the reservoir.

14. A method for production of polymeric nanofibres by electric or electrostatic spinning of a polymer solution or melt using the device according to claim 4, comprising:

feeding the polymer solution or melt from the reservoir via the conduit to the spinning surface;

supplying AC or DC voltage to the spinning electrode or to the polymer solution or melt;

wherein the polymer solution or melt is fed to the spinning surface by rotating the screw shaft within the inner space of the conduit;

feeding an excess of the polymer solution or melt to the spinning surface such that unspun polymer solution or melt washes the spinning surface and flows by gravity down onto a collecting surface where no further spinning process takes place.

15. The method according to claim 14, wherein the collecting surface comprises a collecting groove with at least one hole in communication with the reservoir.

* * * * *